US010237925B2

(12) United States Patent
Anton Falcon et al.

(10) Patent No.: US 10,237,925 B2
(45) Date of Patent: Mar. 19, 2019

(54) COOKING APPLIANCE

(71) Applicant: BSH Hausgeräte GmbH, Munich (DE)

(72) Inventors: Daniel Anton Falcon, Saragossa (ES); Alvaro Cortes Blanco, Saragossa (ES); Oscar Garcia-Izquierdo Gango, Saragossa (ES); Paul Muresan, La Cartuja (ES); Ramon Peinado Adiego, Saragossa (ES); Diego Puyal Puente, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 124 days.

(21) Appl. No.: 15/122,939

(22) PCT Filed: Feb. 27, 2015

(86) PCT No.: PCT/IB2015/051463
§ 371 (c)(1),
(2) Date: Sep. 1, 2016

(87) PCT Pub. No.: WO2015/145278
PCT Pub. Date: Oct. 1, 2015

(65) Prior Publication Data

US 2017/0079092 A1 Mar. 16, 2017

(30) Foreign Application Priority Data

Mar. 24, 2014 (ES) ..... 201430405

(51) Int. Cl.
*H05B 6/12* (2006.01)
*H05B 6/06* (2006.01)

(52) U.S. Cl.
CPC ..... *H05B 6/062* (2013.01); *H05B 6/065* (2013.01)

(58) Field of Classification Search
CPC . H05B 6/04; H05B 6/06; H05B 6/062; H05B 6/065; H05B 6/08; H05B 6/1209
(Continued)

(56) References Cited

U.S. PATENT DOCUMENTS 4,112,286 A 9/1978 Alderman et al.
2011/0233199 A1* 9/2011 Garcia Jimenez ..... H05B 6/065 219/661

(Continued)

FOREIGN PATENT DOCUMENTS

EP 2680668 A1 1/2014

OTHER PUBLICATIONS

International Search Report PCT/IB2015/051463 dated Jun. 12, 2015.

*Primary Examiner* — Hung D Nguyen
(74) *Attorney, Agent, or Firm* — Michael E. Tschupp; Andre Pallapies; Brandon G. Braun

(57) ABSTRACT

A cooking appliance apparatus includes an inductor, an inverter to supply a high-frequency heating current for the inductor, and a switch to break and/or establish at least one conduction path between the at least one inverter and the at least one inductor. A control unit is provided to deactivate the inverter during a first time interval and to initiate a switching of the switch, with the switching starting and ending within a second time interval, which in a normal operating state is arranged within the at least one first time interval and which in an incorrect operating state has at least one time point, which lies outside the at least one first time interval. The control unit is configured to match the first time interval and the second time interval dynamically to one another.

20 Claims, 5 Drawing Sheets

(58) Field of Classification Search
USPC ..... 219/620, 622, 624, 660–668, 670–672
See application file for complete search history.

(56) References Cited

U.S. PATENT DOCUMENTS

| | | | |
|---|---|---|---|
| 2013/0043239 | A1 | 2/2013 | Anton Falcon et al. |
| 2013/0087554 | A1 | 4/2013 | Anton Falcon et al. |

* cited by examiner

COOKING APPLIANCE

CROSS-REFERENCES TO RELATED APPLICATIONS

This application is the U.S. National Stage of International Application No. PCT/IB2015/051463, filed Feb. 27, 2015, which designated the United States and has been published as International Publication No. WO 2015/145278 and which claims the priority of Spanish Patent Application, Serial No. P201430405, filed Mar. 24, 2014, pursuant to 35 U.S.C. 119(a)-(d).

BACKGROUND OF THE INVENTION

A cooking appliance apparatus with a least one inductor, at least one inverter, which is provided to supply a high-frequency heating current for the at least one inductor, and at least one switch, which is provided to break and/or establish a conduction path between the at least one inverter and the at least one inductor, is known from WO 2011/135470 A1. The cooking appliance apparatus also has a control unit, which is provided to deactivate the inverter during a certain time interval and to initiate a switching preferably of the at least one switch within the time interval, with switching starting and ending within the time interval. A control program, for controlling the time interval here is predefined in a fixed manner in the control unit.

BRIEF SUMMARY OF THE INVENTION

The object of the invention is in particular to provide a generic cooking appliance apparatus with improved attributes in respect of operating safety. According to the invention the object is achieved by the characterizing features of the independent claims, while advantageous embodiments and developments of the invention will emerge from the subclaims.

The invention is based on a cooking appliance apparatus, in particular an induction cooktop apparatus, with at least one inductor, at least one inverter, which is provided to supply a high-frequency heating current for the at least one inductor, at least one switch, which is provided to break and/or establish at least one conduction path between the at least one inverter and the at least one inductor, and a control unit, which is provided to deactivate the at least one inverter during at least one first time interval and to initiate a switching of the at least one switch, with switching starting and ending within at least one second time interval, which in a normal operating state is arranged in particular entirely, preferably at least essentially centrally and particularly preferably centrally, within the at least one first time interval and which in an incorrect operating state has at least one time point, which lies outside the at least one first time interval.

It is proposed that the control unit is provided in at least one operating state, preferably the incorrect operating state, to match the at least one first time interval and the at least one second time interval dynamically to one another.

A "cooking appliance apparatus" refers in particular to at least a part, in particular a subassembly, of a cooking appliance, in particular of a cooktop and preferably of an induction cooktop. In particular the cooking appliance apparatus can also comprise the entire cooking appliance, in particular the entire cooktop and preferably the entire induction cooktop. In at least one operating state the at least one inverter is operated at a frequency of at least 1 kHz, advantageously at least 10 kHz, preferably at least 20 kHz and particularly preferably maximum 100 kHz. The high-frequency heating current has in particular a corresponding frequency, flows through the at least one inductor in at least one operating state and is in particular provided to heat in particular cookware, in particular by means of eddy current and/or magnetization change effects. A "conduction path" in this context refers in particular to an electrically conducting connection between at least two points. "Provided" means in particular specifically programmed, designed and/or equipped. That an object is provided for a specific function means in particular that the object satisfies and/or performs said specific function in at least one application and/or operating state. The at least one first time interval advantageously has a duration between 1 ms and 20 ms, preferably between 2 ms and 15 ms and particularly preferably between 5 ms and 10 ms. In particular the at least one first time interval is maximum 50%, advantageously maximum 30%, preferably maximum 10% and particularly preferably maximum 5% greater than the at least one second time interval. A maximum duration of the at least one first time interval here is preferably defined by an entire cycle duration of a network voltage of a power supply network and for operation in Europe is in particular maximum 20 ms and in particular for operation in North and Central America is maximum 16.33 ms. The control unit is preferably provided to select the first time interval such that the network voltage of the power supply network demonstrates a minimum at least essentially in a center of the first time interval. Alternatively the control unit can also be provided to select the first time interval such that the network voltage of the power supply network demonstrates a maximum at least essentially in a center of the first time interval. A "center" of the first time interval refers in particular to a time point that is at the same temporal distance from an end and a start of the time interval. That the voltage demonstrates an extremum "at least essentially" in the center of the first time interval means in particular that that the extremum is at a distance of maximum 25%, preferably maximum 10% and particularly preferably maximum 2% of an overall duration of the time interval from the center. That the "control unit is provided to deactivate the at least one inverter during at least one first time interval" means in particular that the control unit is provided to start at least one deactivation process of the at least one inverter during at least one first time interval and/or to complete, in particular entirely, at least one activation process of the at least one inverter during the at least one first time interval. A start time point of the at least one first time interval here can correspond to at least one start time point of the at least one deactivation process. An end time point of the at least one first time interval can also correspond to at least one end time point of the at least one activation process. The control unit is preferably provided to deactivate the at least one inverter entirely during the at least one first time interval, such that the at least one inverter is inactive during the entire at least one first time interval. The at least one switch could be configured for example as an electronic switch, in particular as a transistor, in particular as a bipolar transistor and/or a MOSFET. However the switch is advantageously configured as a mechanical switch, in particular as a contactor and/or preferably as a relay. In particular the at least one switch here can be configured as an on switch, in particular an SPST switch, DPST switch, SPCO switch and/or SPTT switch, and/or as a toggle switch, in particular an SPDT switch, DPDT switch and/or DPCO switch. A "switching" of the at least one switch refers in particular to a release of at least one electrically conducting connection the switch has in at least one operating state and/or an establishing of at least one electrically conducting connection. The expression that "the control unit is provided to initiate a switching of the at least one switch" means in particular that the control units transmits at least one control signal to a driver circuit of the at least one switch and/or directly to the at least one switch, in order to trigger a switching operation in particular directly and/or after a certain time and/or at a defined time point. A "switching operation" of a switch refers in particular to an operation, in which the switch changes its switching state. During the switching operation in particular the switch is in a non-conducting and/or bouncing state. That switching "starts and ends within a time interval" means in particular that a release of at least one electrical connection and/or an establishing of at least one electrical connection is completed entirely within the time interval, with in particular the coming together of two contacts of the switch that come together to establish the at least one conducting connection being entirely completed before an end of the time interval. That "the at least one second time interval is arranged within the at least one first time interval" means in particular that an overlap between the at least one first time interval and the at least one second time interval corresponds to the at least one second time interval. In particular a start time point and an end time point of the at least one second time interval lie within the at least one first time interval. That "the at least one second time interval is arranged centrally within the at least one first time interval" means in particular that a center point of the at least one first time interval and a center point of the at least one second time interval overlap. "At least essentially centrally" in this context means in particular a relative deviation of the two center points of less than 5%, preferably less than 2% and particularly preferably less than 1%. The incorrect operating state corresponds in particular to a state, in which switching takes place at least partially outside the at least one first time interval. The control unit is provided in particular to identify and/or detect an incorrect operating state when one such occurs and to correct it, preferably in such a manner that the at least one second time interval is arranged within the at least one first time interval. The term "dynamically" refers in particular to an in particular automatic matching and/or adjustment during operation of the cooking appliance apparatus. Neither a software modification for the cooking appliance apparatus nor human intervention is required here in particular. That the control unit is provided to "match" two time intervals to one another means in particular that the control unit is provided to set a relative location of the time intervals to one another and/or to set a length of at least one of the time intervals.

This embodiment provides a generic cooking appliance apparatus with improved attributes in respect of operating safety, as in particular voltage peaks due to sudden switching and/or operation of the at least one inverter without load can be avoided. In particular the at least one switch can be switched in a preserving manner in that when the at least one switch is switched, it can be ensured that there is no current and/or just a small current flowing through the at least one switch, the at least one inductor and/or the at least one inverter. It is also possible to compensate in particular for deviations in a response time of the at least one switch from a setpoint response time from activation to a start of a switching operation. It is therefore possible to take into account and dynamically adjust possible fluctuations in an overall switching time, in particular due to temperature fluctuations and/or due to aging phenomena of the at least one switch and/or due to different switch manufacturers, in particular also during operation of the cooking appliance, thereby advantageously increasing an operating time, in particular a fault-free operating time and/or a service life of the cooking appliance apparatus, in particular of the at least one switch.

In particular in at least one operating state, in particular the incorrect operating state, the control unit is preferably provided to change at least one parameter of the at least one first time interval and/or of the at least one second time interval dynamically and in particular to adjust it based on the respective other time interval. A "parameter" in this context refers in particular to a characteristic variable of a time interval. This allows the cooking appliance apparatus to be adjusted, in particular during operation, based on changing conditions, for example in particular a temperature.

If the at least one parameter is defined by at least one interval length and/or at least one interval position, the two time intervals can advantageously be changed and in particular can be matched to one another in a simple manner. An "interval length" here refers in particular to a temporal duration of the interval, in particular from a start time point to an end time point. An "interval position" also refers in particular to a temporal occurrence of the interval, in particular a start point of the interval.

It is further proposed that in the incorrect operating state the control unit is provided to adjust the at least one parameter in such a manner that the at least one second time interval is arranged entirely within the at least one first time interval. This allows a possible incorrect operating state in particular to be corrected and advantageously allows a normal operating state to be restored.

In one embodiment of the invention it is proposed that the control unit has at least one detection unit, which is provided to detect at least one switching characteristic of the at least one switch. A "switching characteristic" in this context refers in particular to a characteristic of the at least one switch and/or a variable characterizing a switching state of the at least one switch. A "switching state" of the at least one switch here refers in particular to a conducting state, in particular the presence of an electrical connection, and/or a non-conducting state, in particular the absence of an electrical connection, and/or a bouncing state, in particular a coming together of two contacts of the switch. The detection unit is preferably provided to detect at least a presence and/or an absence of a voltage and/or a current, in order thus to be able to draw a conclusion about a switching state of the at least one switch. The detection unit is preferably provided to measure a voltage value and/or a current value. This allows in particular an actual operating state and/or switching state to be determined and compared with a normal operating mode and/or theoretical switching state and/or setpoint switching state.

The at least one switching characteristic is preferably a heating current characteristic. A "heating current characteristic" in this context refers in particular to a characteristic of the heating current and or a variable characterizing the heating current, preferably a voltage dropping at at least one contact of the at least one inverter and/or of the at least one inductor and/or of the at least one switch, a potential and/or the heating current. This simplifies in particular verification of the normal operating state.

It is further proposed that in particular in at least one operating state the control unit is provided to determine a presence of at least one time point, preferably a number of time points and/or a time range, of the at least one second time interval, which lies outside the at least one first time interval, in particular by analyzing the detected data from the detection unit. This advantageously allows an incorrect operating state and/or switching outside the first time interval to be determined.

In one preferred embodiment of the invention it is proposed that in particular in at least one operating state, in particular the incorrect operating state, the control unit is provided to determine the at least one time point from a comparison of at least one detected switching characteristic, in particular detected by the detection unit, with a setpoint switching state. In this context a "setpoint switching state" refers in particular to a switching state determined theoretically and/or calculated by the control unit based on the activation of the at least one inverter and/or the at least one switch, in which the at least one switch is to be found at a defined time point. In particular the theoretically determined switching state can differ from the actual switching state, in particular as detected by the control unit and/or the detection unit, in particular due to aging phenomena, temperature dependencies and/or manufacturer dependencies of the switching time of the at least one switch, in particular in the incorrect operating state. The control unit is also provided in particular to determine whether the at least one time point is located temporally before the at least one first time interval and/or temporally after the at least one first time interval. This allows in particular improved detection of the incorrect operating state to be achieved. It is also possible in particular to simplify correction of the incorrect operating state.

It is further proposed that in particular in at least one operating state, in particular the incorrect operating state, the control unit is provided to determine at least one temporal position characteristic of the at least one time point, preferably a number of time points and/or the time range. A "position characteristic" here refers in particular to a characteristic characterizing the temporal position of the at least one time point. This in particular further simplifies correction of the incorrect operating state.

In a further embodiment of the invention it is proposed that the detection unit is provided to output a high level, in particular a logical "1", in the incorrect operating state. In particular the detection unit is provided to output a low level, in particular a logical "0" in a normal operating state. Thus in this instance the detection unit is provided in particular to output a digital signal. To this end the detection unit advantageously has at least one logic unit. A "logic unit" in this context refers in particular to a unit which has at least one logic gate, in particular a NOT gate, AND gate, NAND gate, OR gate, NOR gate, XOR gate and/or XNOR gate. The logic unit also preferably has a number of inputs and in particular one output, which is preferably connected directly to an analysis unit of the control unit. This allows in particular simple and economical detection of an operating state to be achieved.

An inventive method is based on a method for operating a cooking appliance apparatus, with at least one inductor, at least one inverter, which is provided to supply a high-frequency heating current for the at least one inductor, and at least one switch, which is provided to break and/or establish at least one conduction path between the at least one inverter and the at least one inductor, the at least one inverter being deactivated during at least one first time interval and a switching of the at least one switch being initiated and with switching starting and ending within at least one second time interval, which in a normal operating state is arranged within the at least one first time interval and which in an incorrect operating state has at least one time point, which lies outside the at least one first time interval.

It is proposed that the at least one first time interval and the at least one second time interval are matched dynamically to one another, thereby advantageously improving operating safety and in particular allowing possible fluctuation of a switching time to be take into account and dynamically adjusted, in particular also during operation of the cooking appliance apparatus.

BRIEF DESCRIPTION OF THE DRAWINGS

Further advantages will emerge from the description of the drawing which follows. The drawing shows two exemplary embodiments of the invention. The drawing, description and claims contain numerous features in combination. The person skilled in the art will expediently also consider the features individually and combine them in useful further combinations. In the drawing:

DETAILED DESCRIPTION OF EXEMPLARY EMBODIMENTS OF THE PRESENT INVENTION

Figure 1:
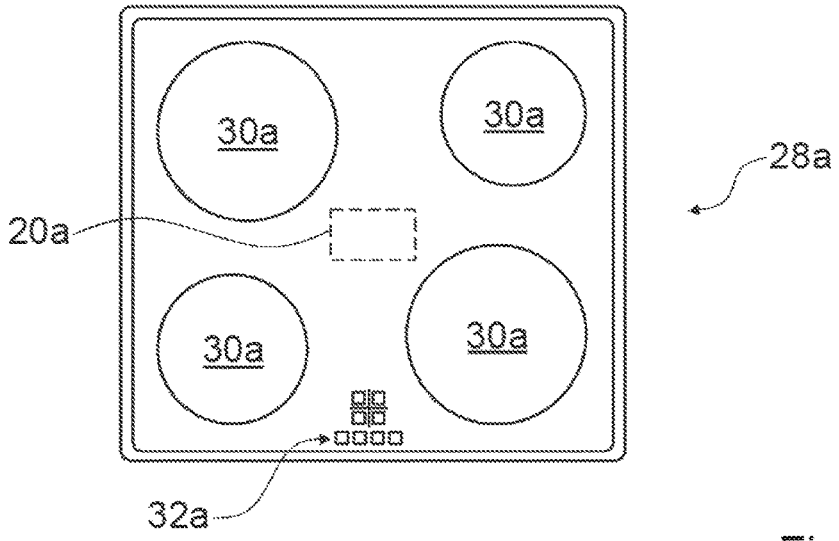
FIG. 1 shows a top view of a cooking appliance configured as an induction cooktop with four heating zones and a cooking appliance apparatus.

FIG. 1 shows a schematic top view of an exemplary cooking appliance 28*a* configured as an induction cooktop. In the present instance the cooking appliance 28*a* has a cooktop plate with four heating zones 30*a*. Each heating zone 30*a* is provided to heat just one cookware element (not shown). The cooking appliance 28*a* also comprises a cooking appliance apparatus. The cooking appliance apparatus has an operating unit 32*a*. The operating unit 32*a* allows a user to input and/or select a power stage. The cooking appliance apparatus has a control unit 20*a* to control a heating power. The control unit 20*a* has a computation unit, a storage unit and an operating program stored in the storage unit, which is provided to be executed by the computation unit.

Figure 2:
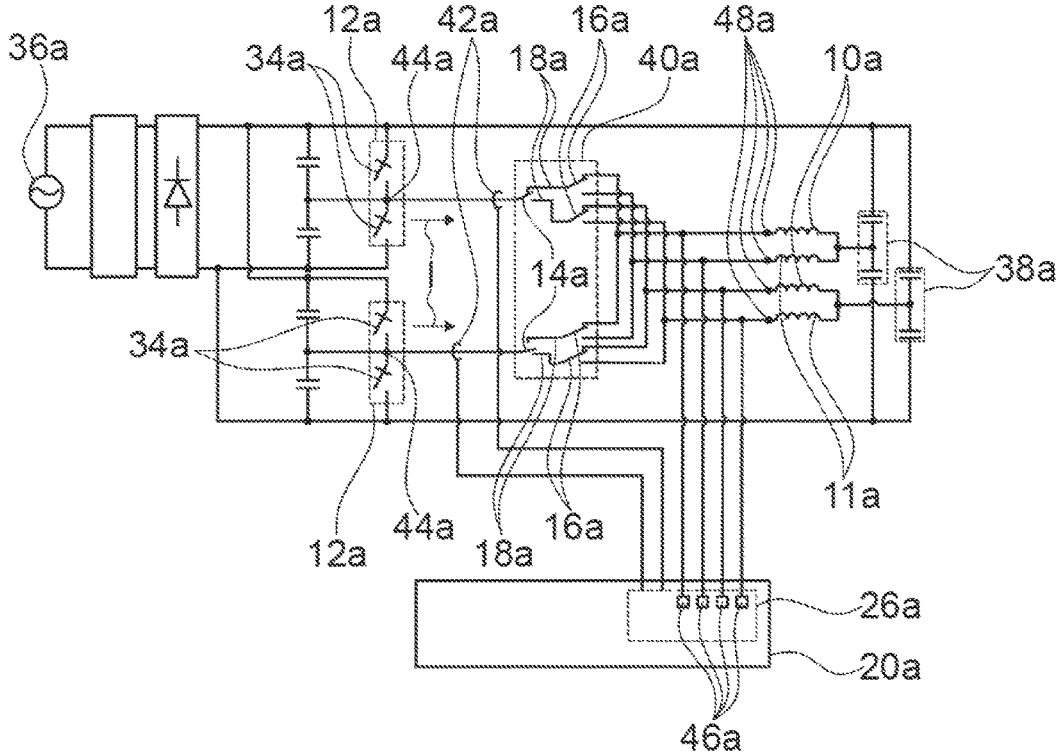
FIG. 2 shows a schematic circuit diagram of the cooking appliance apparatus.

FIG. 2 shows a schematic circuit diagram of the cooking appliance apparatus. The cooking appliance apparatus has four inductors 10*a*, 11*a*. Each inductor 10*a*, 11*a* is assigned to one of the heating zones 30*a*. The cooking appliance apparatus further comprises two inverters 12*a*. Each inverter 12*a* has two semiconductor switches 34*a*, in particular IGBTs. The control unit 20*a* is connected (not shown) to control connectors of the semiconductor switches 34*a*. Each of the inverters 12*a* is provided to convert a pulsing rectified network voltage of an energy source 36*a* to a high-frequency heating current I and in particular to supply it to at least one of the inductors 10*a*, 11*a*.

The cooking appliance apparatus also has two resonance units 38*a*. Each of the resonance units 38*a* is part of an electric oscillating circuit and can be charged by way of the associated inverter 12*a*. The cooking appliance apparatus also has a number of conduction paths 18*a*. In the present instance each of the inverters 12*a* is connected to the inductors 10*a*, 11*a* by way of conduction paths 18*a*.

The cooking appliance apparatus also has a switching arrangement 40*a*. The switching arrangement 40*a* comprises a number of switches 14*a*, 16*a*. The switches 14*a*, 16*a* are provided to break and/or establish the conduction paths 18*a* between the inverters 12*a* and the inductors 10*a*, 11*a*. In the present instance the switching arrangement 40*a* comprises six switches 14*a*, 16*a*. The switches 14*a*, 16*a* are of identical structure. The switches 14*a*, 16*a* are each configured as toggle switches. The switches 14*a*, 16*a* are configured as relays in the present instance. The conduction paths 18*a* can be broken by two switches 14*a*, 16*a*. Two first switches 14*a* are connected respectively to a heating current output 44*a* of the inverter 12*a*. The two first switches 14*a* are also connected respectively to two second switches 16*a*. The two second switches 16*a* are connected respectively to a heating connector 48*a* of one of the inductors 10*a*, 11*a*.

The control unit 20*a* also comprises a detection unit 26*a*. The detection unit 26*a* is provided to detect at least a presence and/or an absence of a voltage and/or a current. In the present instance the detection unit 26*a* comprises six detectors. In the present instance the detection unit 26*a* comprises two current detectors 42*a*. A current detector 42*a* is assigned to each inverter 12*a*. The current detectors 42*a* assigned to the inverters 12*a* here are arranged at the heating current output 44*a* of the respective inverter 12*a* and are provided to detect the heating current I supplied by the respective inverter 12. In the present instance the detection unit 26*a* further comprises four voltage detectors 46*a*. Each inductor 10*a*, 11*a* is assigned a voltage detector 46*a*, in each instance in particular at a connector of the inductors 10*a*, 11*a* facing the switching arrangement 40*a*. The voltage detectors 46*a* assigned to the inductors 10*a*, 11*a* are respectively arranged at the heating connector 48*a* of the inductors 10*a*, 11*a*. Alternatively it is also conceivable to dispense with voltage detectors entirely and in particular only to use two current detectors, in particular at a heating current output of the respective inverter. It is also conceivable to provide four further current detectors, in particular instead of the voltage detectors. It is also conceivable to use at least one detector both as a voltage detector and a current detector, in particular by using two different analog circuits.

The cooking appliance apparatus can also comprise further units, for example rectifiers, filters and/or voltage converters.

Figure 3:
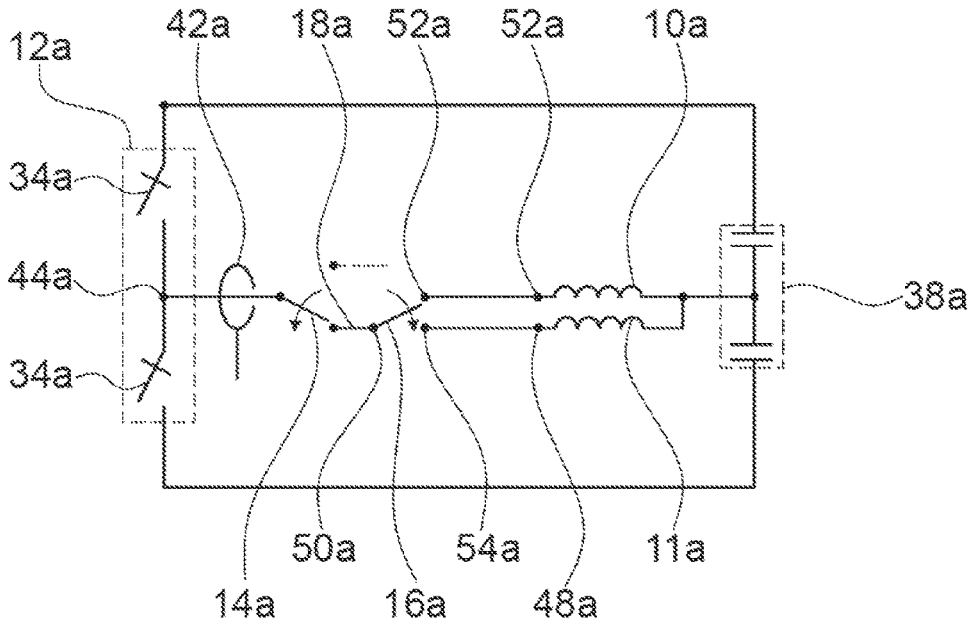
FIG. 3 shows a simplified schematic partial view of the circuit diagram of the cooking appliance apparatus.

FIG. 3 shows a simplified schematic partial circuit of the cooking appliance apparatus from FIG. 2. Only one of the inverters 12*a*, two of the switches 14*a*, 16*a*, two of the inductors 10*a*, 11*a* and one of the current detectors 42*a* are shown here. Such simplification is however not intended to represent a restriction; it is simply to explain one mode of operation of the cooking appliance apparatus.

The inverter 12*a* can be connected alternately to one of the two inductors 10*a*, 11*a* by way of the second switch 16*a*. The second switch 16*a* has three contacts 50*a*, 52*a*, 54*a*. In the illustrated instance the first contact 50*a* is connected to the first switch 14*a*. The first contact 50*a* is therefore connected to the heating current output 44*a* of the inverter 12*a* in particular by way of the first switch 14*a*. The second contact 52*a* is also connected to the heating connector 48*a* of the first inductor 10*a*. The third contact Ma is connected to the heating connector 48*a* of the second inductor 11*a*. In the present instance the first contact 50*a* and the second contact 52*a* are connected in a conducting manner The second switch 16*a* is also connected (not shown) to the control unit 20*a*. The current detector 42*a* is arranged between the first switch 14*a* and the heating current output 44*a* of the inverter 12*a*. The current detector 42*a* is also arranged between the first contact 50*a* of the second switch 16*a* and the heating current output 44*a* of the inverter 12*a*.

One mode of operation of the cooking appliance apparatus is described in the following. Only one operating state is described, in which the second switch 16*a* is connected while the first switch 14*a* remains closed.

The control unit 20*a* causes the two inductors 10*a*, l la to be supplied alternately with power by the inverter 12*a* during the entire operating cycle of the cooking appliance apparatus, in particular if the heating zones 30*a* assigned to the inductors 10*a*, 11*a* are to be operated simultaneously. In this instance the control unit 20*a* is provided to operate the inductors 10*a*, 11*a* in a time multiplex. In at least one operating state the control unit 20*a* is provided to initiate switching of the at least one second switch 16*a*. The control unit 20*a* is thus provided to activate the at least one second switch 16*a* by means of a control signal.

Because of a certain inertia of the second switch 16*a*, switching takes place after a defined response time after activation, for example after 1 ms. Preferably and particularly in a normal operating state switching takes place when there is no heating current I flowing through the second switch 16*a*. This improves operating safety, as it can be ensured in particular that voltage peaks due to an induction voltage of the inductors 10*a*, 11*a* and/or operation of the inverters 12*a* without load can be avoided.

The control unit 20*a* is also provided to deactivate the heating current I during a first time interval 22*a*. The control unit 20*a* here is provided to stop operation of the inverter 12*a* during the entire first time interval 22*a* so that the inverter 12*a* in particular is deactivated.

Furthermore switching of the switch 16*a* starts and ends in a second time interval 24*a*. The second time interval 24*a* includes the release of an electrical connection, the establishing of an, in particular further, electrical connection and possible bouncing of two contacts 50*a*, 52*a*, 54*a* of the second switch 16*a*. The second time interval 24*a* therefore starts with the release of the electrical connection and ends when a coming together of two contacts 50*a*, 52*a*, 54*a* of the second switch 16*a* is entirely completed. The second time interval 24*a* therefore corresponds to a switching time and/or a switching operation of the second switch 16*a*.

Figure 4:
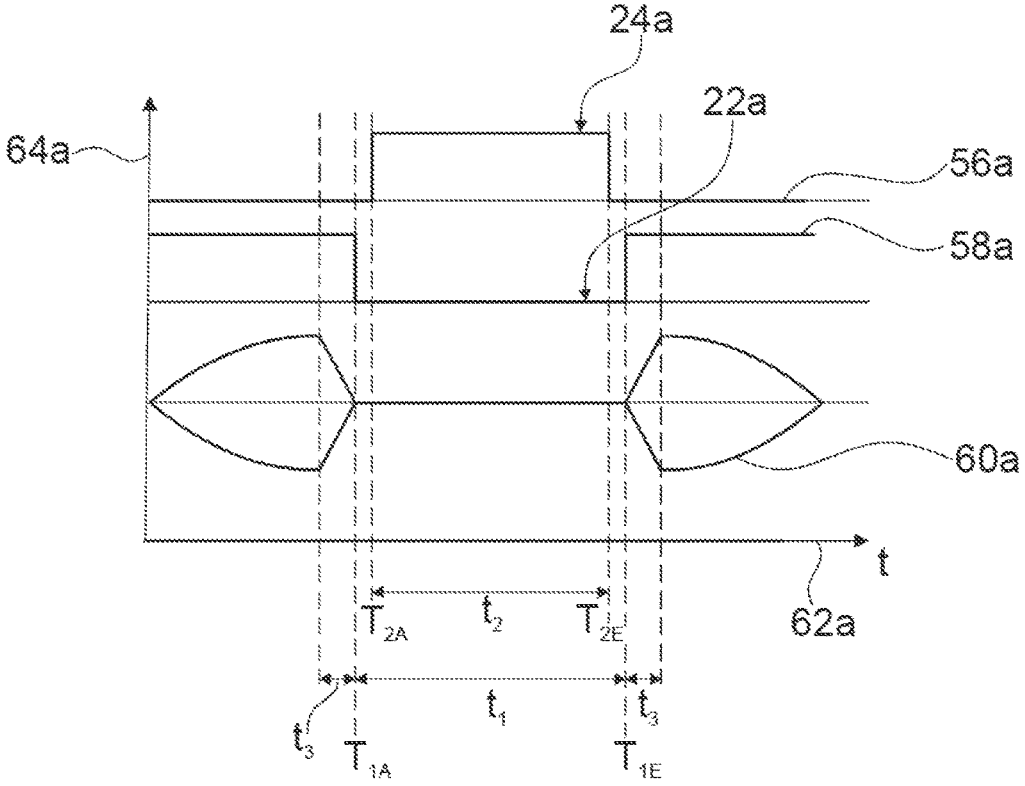
FIG. 4 shows diagrams of a normal operating state of the cooking appliance apparatus.

The control unit 20*a* is provided to operate the cooking appliance apparatus in a normal operating state. Diagrams of a normal operating state are shown in FIG. 4. At least one incorrect operating state can also occur however. The control unit 20*a* is then provided to identify an occurrence of the incorrect operating state and to correct it in such a manner that the normal operating state is restored. Exemplary diagrams of incorrect operating states are shown in FIGS. 5 and 6.

The time is shown on the x-axis 62*a* in FIG. 4. The y-axis 64*a* is the variable axis. A curve 56*a* shows a switching state of the second switch 16*a*. A logical "1" here characterizes a switching operation, in particular a non-conducting and/or bouncing state, of the second switch 16*a*. A logical "0" characterizes a non-switching state, in particular a long-term conducting state, of the second switch 16*a*. The second time interval 24*a* starts at a start time point $T_{2A}$. The start time point $T_{2A}$ defines a start of the switching operation. The second time interval 24*a* ends at an end time point $T_{2E}$. The end time point $T_{2E}$ defines an end of the switching operation. A curve 58*a* shows a schematic representation of an envelope of a potential profile at the first contact 50*a*. A zero signal of the second curve 58*a* defines the first time interval 22*a* and therefore in particular a fully deactivated inverter 12*a*. The first time interval 22*a* starts at a starts time point $T_{1A}$. The first time interval 22*a* ends at an end time point $T_{1E}$. A signal curve 60*a* shows a low-frequency envelope of the high-frequency heating current I detected by the current detector 42*a*. The heating current I is deactivated during the entire first time interval 22*a*. Therefore the heating current I has a zero signal during the entire first time interval 22*a*.

The first time interval 22*a* has a duration $t_1$ of 10 ms. The second time interval 24*a* has a duration $t_2$ of 8 ms. The first time interval 22*a* is therefore in particular 2 ms longer than the second time interval 24*a*. In the normal operating state the second time interval 24*a* is also arranged entirely within the first time interval 22*a*. Therefore the switching of the second switch 16*a* starts and ends within the first time interval 22*a*. The second switch 16*a* is also current-free during the second time interval 24*a*. In the present instance of normal operating state the second time interval 24*a* lies centrally within the first time interval 22*a*. This ensures particularly efficient and safe switching. The control unit 20*a* also switches the inverter 12*a*, in particular a switching frequency of the inverter 12*a*, in such a manner that the envelope of the heating current I approaches the zero signal gradually and in particular not abruptly. The envelope of the heating current I drops in a time range $t_3$, which is in particular directly before the first time interval 22*a*. The envelope of the heating current I gradually approaches the zero signal in the time range $t_3$. In the present instance the time range $t_3$ has a duration of 2 ms. The envelope of the heating current I rises in a second time range $t_3$, which is in particular directly after the first time interval 22*a*. In the second time range $t_3$ the envelope of the heating current I gradually approaches the rectified network voltage. In the present instance the second time range $t_3$ has a duration of 2 ms. The envelope of the heating current I therefore changes gradually, thereby avoiding noise. Details relating to the switching method used can be found in the publication WO 2012/001603 A1.

Figure 5:
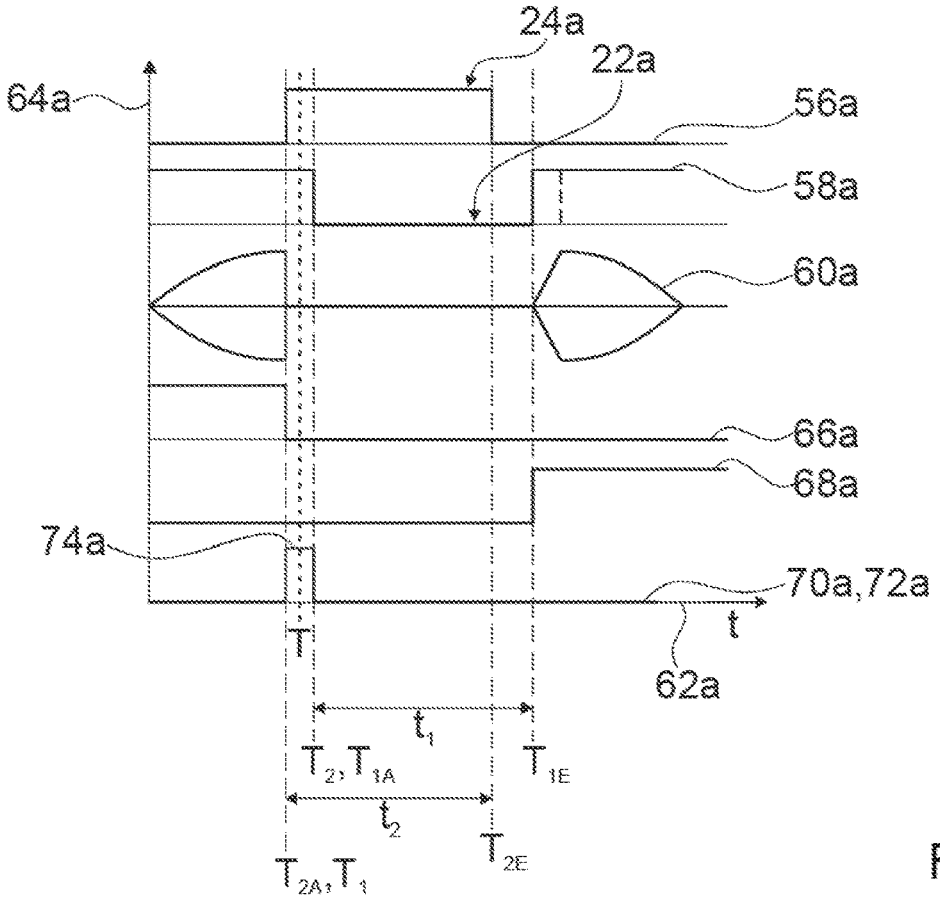
FIG. 5 shows diagrams of a first incorrect operating state of the cooking appliance apparatus.
Figure 6:
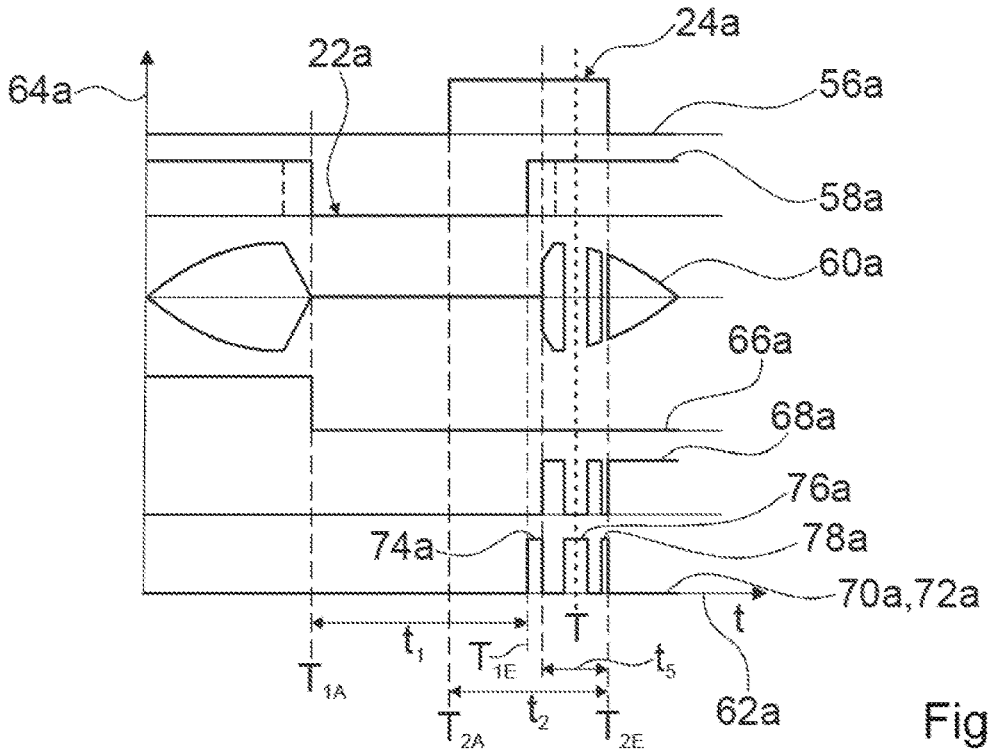
FIG. 6 shows diagrams of a second incorrect operating state of the cooking appliance apparatus.

FIG. 5 shows a diagram of a first example of an incorrect operating state. An incorrect operating state can occur for example as a result of a change in the switching time and/or a response time of at least one of the switches 14*a*, 16*a* due to temperature fluctuations and/or aging phenomena. The second time interval 24*a* is then not entirely within the first time interval 22*a*. The time is shown on the x-axis 62*a*. The y-axis 64 is the variable axis. The first three curves shown correspond to the curves in FIG. 4. A curve 66*a* shows a schematic representation of an envelope of a potential profile at the second contact 52*a*. A curve 68*a* shows a schematic representation of an envelope of a potential profile at the third contact 54*a*. A curve 70*a* shows a schematic representation of an error curve 72*a* determined by the control unit 20*a* in particular from an activation signal of the inverter 12*a* and the detected envelope of the heating current I.

The signal curve 60*a* drops relatively quickly to zero at a time point $T_1$, which corresponds in particular to the start time point $T_{2A}$ of the second time interval 24*a*. The time point $T_1$ is temporally before the start time point $T_{1A}$ of the first time interval 22*a*. The time point $T_1$ is therefore temporally before the first time interval 22*a*. In this example therefore the second switch 16*a* switches before the inverter 12*a* has been deactivated. At least one time point T of the second time interval 24*a* is therefore then outside the first time interval 22*a*.

The control unit 20*a* is provided to determine a presence of the at least one time point T of the second time interval 24*a*. To this end the control unit 20*a* is provided to detect a heating current characteristic. In the present instance the control unit 20*a* is provided to detect the envelope of the heating current I by means of the current detector 42*a*. Alternatively a control unit can also be provided to detect a high-frequency heating current and/or a different switching characteristic. The control unit 20*a* is further provided to determine the time point T from a comparison of the detected envelope of the heating current I with a setpoint switching state. The control unit 20*a* is provided to determine the setpoint switching state from the activation signal of the inverter 12*a*. In the present instance the setpoint switching state is defined by the first time interval 22*a*.

In the present instance the error curve 72*a* has an individual pulse 74*a*. The pulse 74*a* results at least essentially from a comparison of the curve 58*a* with the signal curve 60*a*. A start time point of the pulse 74*a* is defined by the time point $T_1$. The start time point of the pulse 74*a* is therefore determined by the start time point $T_{2A}$ of the second time interval 24*a*. An end time point $T_2$ of the pulse 74*a* is defined by the start time point $T_{1A}$ of the first time interval 22*a*. A width of the pulse 74*a* in the present instance is around 1 ms.

If an incorrect operating state is identified by the control unit 20*a*, the control unit 20*a* is provided to match the first time interval 22*a* and the second time interval 24*a* dynamically to one another, in particular during operation of the cooking appliance apparatus. In the present instance the control unit 20*a* is provided to change an interval position of the second time interval 24*a* dynamically, in particular at the latest 10 ms after the occurrence of the incorrect operating state. The control unit 20*a* is further provided to change the control signal for activating the second switch 16*a* in such a manner that the second time interval 24*a* is arranged back within, preferably centrally within, the first time interval 22*a* in a further switching operation. The control unit 20*a* can determine a temporal position characteristic of the at least one time point T based on the temporal occurrence of the time point T and/or of a different time point of the pulse 74*a*. Alternatively a control unit can be provided to determine a temporal position characteristic based on the temporal occurrence of a different time point of a pulse, in particular a start time point and/or an end time point of a pulse, and/or all time points of a pulse, in particular all time points of a pulse that are arranged outside a first time interval. This allows the determination of a time period to be changed. In the present instance the time period to be changed corresponds at least to the width of the pulse 74*a*. In the present instance the control unit 20*a* is provided to delay the start time point $T_{2A}$ of the second time interval 24*a* by at least 1 ms. Alternatively a control unit could also be provided to delay a start time point of a second time interval by 2 ms and/or any other value. It is also conceivable for another parameter to be changed, in particular a duration of a first time interval and/or a start time point of a first time interval.

FIG. 6 shows a diagram of a second example of an incorrect operating state. The time is shown on the x-axis 62*a*. The y-axis 64*a* is the variable axis. The curves here correspond to the curves in FIG. 5. In this instance too the second time interval 24*a* is not entirely within the first time interval 22*a*. This means that the first time interval 22*a* ends while the second switch 16*a* switches. As a result at least one time point T of the second time interval 24*a* lies outside the first time interval 22*a*. The error curve 72*a* determined by the control unit 20*a* has three pulses 74*a*, 76*a*, 78*a*. The bouncing of the contacts 50*a*, 52*a*, 54*a* of the second switch 16*a* means that the error curve 72*a* has three pulses 74*a*, 76*a*, 78*a*. Bouncing takes place in a time range $t_5$. In this instance the control unit 20*a* is provided to change an interval position of the second time interval 24*a* dynamically so that the second interval 24*a* is arranged within the first time interval 22*a* in a further switching operation. The control unit 20*a* here is provided to bring forward the start time point $T_{2A}$ of the second time interval 24*a* temporally.

FIGS. 7 to 10 show a further exemplary embodiment of the invention. The description which follows and the drawing are essentially restricted to the differences between the exemplary embodiments, it being possible in principle also to refer to the drawing and/or the description of the other exemplary embodiment, in particular in FIGS. 1 to 6, for identically marked parts, in particular for parts with identical reference characters. To distinguish between the exemplary embodiments the letter a is used after the reference character for the exemplary embodiment in FIGS. 1 to 6. The letter a is replaced by the letter b in the exemplary embodiment in FIGS. 7 to 10.

The further exemplary embodiment differs from the previous exemplary embodiment at least essentially by a detection unit 26*b* of a control unit 20*b*. The detection unit 26*b* here comprises two additional voltage detectors 46*b*. An additional voltage detector 46*b* is assigned to each inverter 12*b*. The additional voltage detectors 46*b* assigned to the inverters 12*b* are arranged at a heating current output 44*b* of the respective inverter 12*b*. Alternatively current detectors could also be dispensed with. It is also conceivable to use at least one detector as both a voltage detector and a current detector. A detection unit could also have just current sensors, in particular six current sensors, with just one current detector being assigned to each inverter and/or each inductor.

Figure 7:
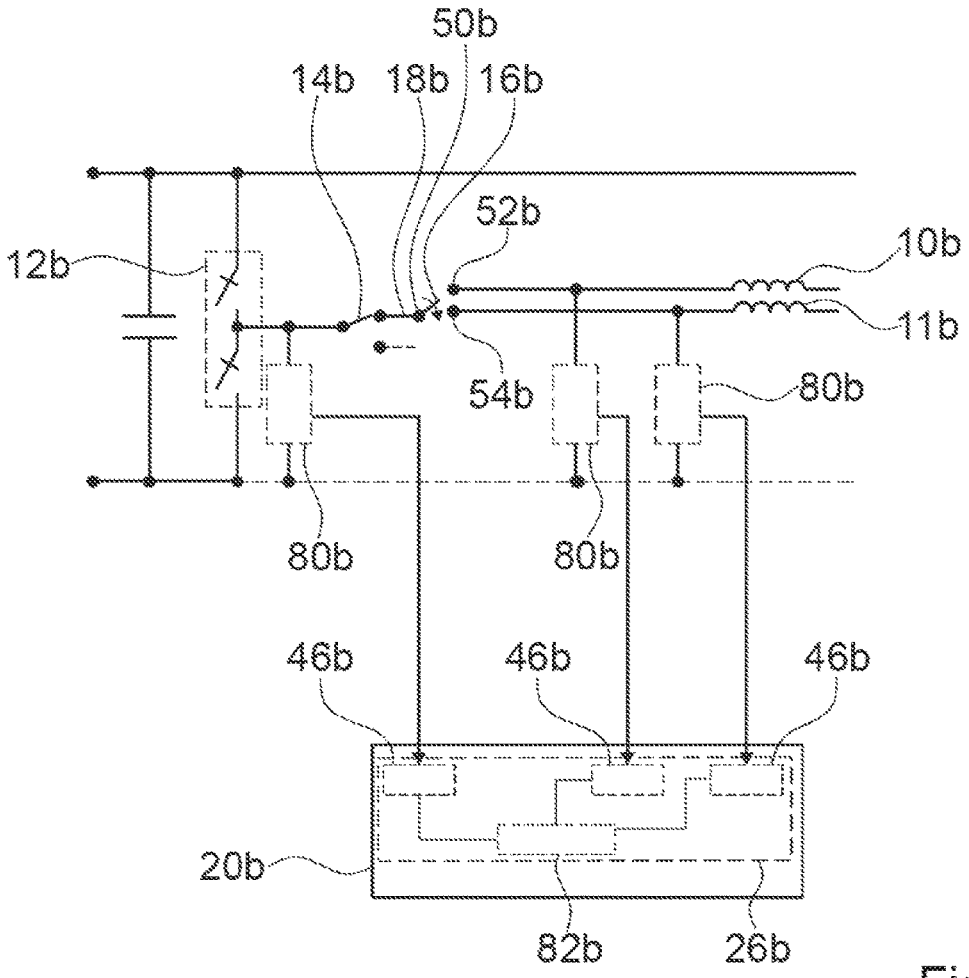
FIG. 7 shows a simplified schematic partial view of a circuit diagram of a further cooking appliance apparatus.

FIG. 7 shows a simplified schematic partial circuit of the cooking appliance apparatus. Only one inverter 12*b*, two switches 14*b*, 16*b*, two inductors 10*b*, 11*b* and three voltage detectors 46*b* of the detection unit 26*b* are shown here.

The second switch 16*b* has three contacts 50*b*, 52*b*, 54*b*. In the present instance the first contact 50*b* and the second contact 52*b* are connected in a conducting manner A voltage detector 46*b* of the detection unit 26*b* is arranged at each of the three contacts 50*b*, 52*b*, 54*b*. In the present instance a filter 80*b* is also arranged between each of the contacts 50*b*, 52*b*, 54*b* and the voltage detectors 46*b*. The detection unit 26*b* also has a logic unit 82*b*. The logic unit 82*b* is provided to process the detected potential of the voltage detectors 46*b*.

Figure 8:
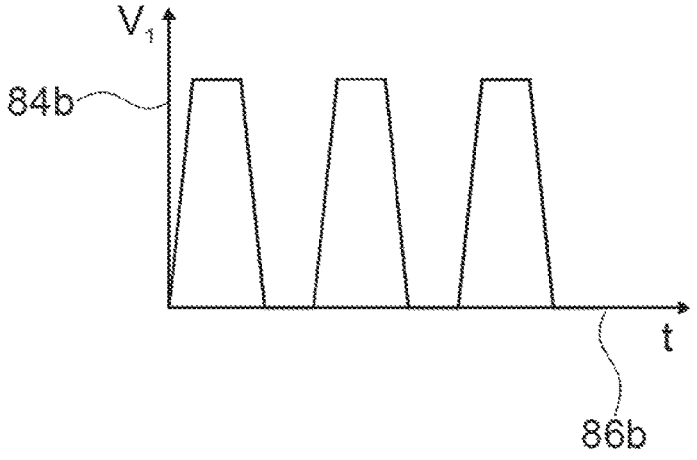
FIG. 8 shows a diagram of a first typical potential profile.
Figure 9:
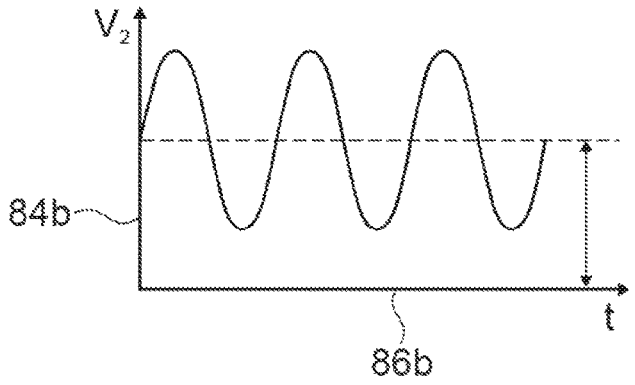
FIG. 9 shows a diagram of a second typical potential profile and FIG. 10 shows diagrams of an operating state of the cooking appliance apparatus from FIG. 7.

FIGS. 8 and 9 show two typical high-frequency potential profiles $V_1(t)$, $V_2(t)$, which can occur at the three contacts 50*b*, 52*b*, 54*b* of the second switch 16*b*. A y-axis 84*b* shows the electrical potential in each instance. The time is shown in each instance on an x-axis 86*b*.

In a normal operating state, in particular in the normal operating state in which the first contact 50*b* and the second contact 52*b* of the switch 16*b* are connected in a conducting manner, the first contact 50*b* and the second contact 52*b* have the first potential profile $V_1(t)$. The first potential profile $V_1(t)$ essentially has the shape of a square-wave signal with steep flanks. Sharp edges mean that high-frequency signal components are contained in a frequency spectrum of the potential profile $V_1(t)$, their frequencies and/or at least a certain frequency component being able to pass through the filter 80*b* at least essentially unimpeded. The first potential profile $V_1(t)$ can therefore be detected by the respective voltage detector 46*b*. The third contact 54*b* of the switch 16*b* also has the second potential profile $V_2(t)$. The second potential profile $V_2(t)$ essentially has the shape of a sinusoidal signal displaced in the direction of the y-axis 84*b*. The sinusoidal signal means that only a few frequency components are contained in a frequency spectrum of the second potential profile $V_2(t)$. These frequency components are at least essentially blocked by the filter 80*b*. The second potential profile $V_2(t)$ can therefore not be detected by the respective voltage detector 46*b*, as the voltage detectors 46*b* are provided in particular to detect steep flanks. The voltage detectors 46*b* here are provided to output a logical "0" on detection of a signal with a potential value above a limit value. The voltage detectors 46*b* are also provided to output a logical "1" on detection of a signal with a potential value below a limit value.

In an incorrect operating state, in particular during a switching of the switch 16*b* outside a first time interval 22*b*, the first contact 50*b* has the first potential profile $V_1(t)$. The second contact 52*b* and the third contact 54*b* of the switch 16*b* have the second potential profile $V_2(t)$.

The control unit 20*b* is now provided to detect and compare the potential profiles at the three contacts 50*b*, 52*b*, 54*b*. The control unit 20*b* is also provided to correct an incorrect operating state when such occurs.

Figure 10:
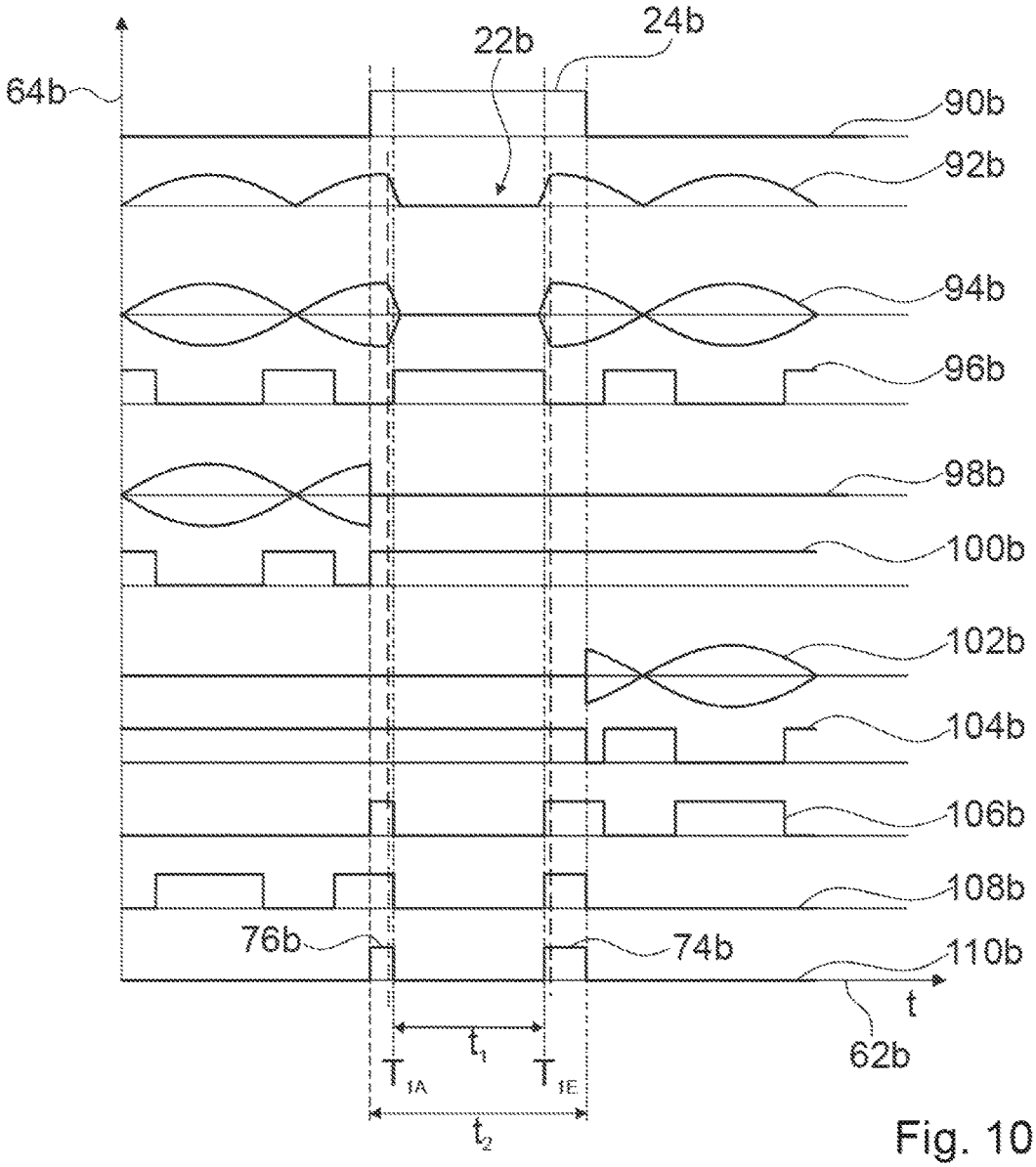

FIG. 10 shows a diagram of an incorrect operating state, wherein a switching takes place both before and after the first time interval 22*b*. The time is shown on an x-axis 62*b*. A y-axis 64*b* is the variable axis.

A curve 90*b* shows a switching state of the second switch 16*b* and thus represents a second time interval 24*b*. A logical "1" characterizes a switching operation, in particular a non-conducting and/or bouncing state, of the second switch 16*b*. A logical "0" characterizes a non-switching state, in particular a long-term conducting state, of the second switch 16*b*. A second curve 92*b* shows a low-frequency envelope of a high-frequency potential profile at the first contact 50*a*. A signal curve 94*b* shows a low-frequency envelope of the high-frequency potential detected by one of the voltage detectors 46*b* at the first contact 50*b*. In this instance a start time point $T_{1A}$ of the first time interval 22*b* corresponds to a deactivation time point of the inverter 12*b*, at which the inverter 12*b* drops below a predefined first potential value. An end time point $T_{1E}$ of the first time interval 22*b* also corresponds to an activation time point of the inverter 12*b*, at which the inverter 12*b* exceeds a predefined second potential value. In the present instance the predefined first potential value and the predefined second potential value are identical. A curve 96*b* shows an output signal of the voltage detector 46*b* arranged at the first contact 50*b*. A signal curve 98*b* shows a low-frequency envelope of the high-frequency potential detected by one of the voltage detectors 46*b* at the second contact 52*b*. A curve 100*b* shows an output signal of the voltage detector 46*b* arranged at the second contact 52*b*. A signal curve 102*b* shows a low-frequency envelope of the high-frequency potential detected by one of the voltage detectors 46*b* at the third contact 54*b*. A curve 104*b* shows an output signal of the voltage detector 46*b* arranged at the third contact 54*b*. A curve 106*b* shows a comparison signal of the output signal of the voltage detector 46*b* arranged at the first contact 50*b* and the output signal of the voltage detector 46*b* arranged at the second contact 52*b* as determined by the logic unit 82*b*. A curve 108*b* shows a comparison signal of the output signal of the voltage detector

46*b* arranged at the first contact 50*b* and the output signal of the voltage detector 46*b* arranged at the third contact 54*b* as determined by the logic unit 82*b*. A curve 110*b* shows the output signal of the detection unit 26n and/or the logic unit 82*b*.

The voltage detectors 46*b* are provided to detect the characteristic potential profiles at the three contacts 50*b*, 52*b*, 54*b* and supply them to the logical unit 82*b*. The logic unit 82*b* is provided to compare the potential profiles. When an incorrect operating state occurs, in particular while the error is occurring, the detection unit 26*b* is provided to output a high level. In the present instance the high level is defined by two pulses 74*b*, 76*b*. The high level can then be detected by the control unit 20*b*. In order to restore a normal operating state, in this instance the control unit 20*b* is provided to increase a duration of the first time interval 22*b*, in particular from 10 ms to 12 ms.

The invention claimed is:

1. A cooking appliance apparatus, comprising:

at least one inductor;

at least one inverter configured to supply a high-frequency heating current for the at least one inductor;

at least one switch configured to break and/or establish at least one conduction path between the at least one inverter and the at least one inductor; and a control unit configured to deactivate the at least one inverter during at least one first time interval and to initiate a switching of the at least one switch, with the switching starting and ending within at least one second time interval, which in a normal operating state is arranged within the at least one first time interval and which in an incorrect operating state has at least one time point, which lies outside the at least one first time interval, said control unit being configured to match the at least one first time interval and the at least one second time interval dynamically to one another, the control unit including:

at least one detection unit configured to detect at least one switching characteristic of the at least one switch;

at least one voltage detector for detecting a potential profile, and a logic unit for processing the detected potential profile.

2. The cooking appliance apparatus of claim 1, constructed in the form of an induction cooktop apparatus.

3. The cooking appliance apparatus of claim 1, wherein the control unit is configured to change at least one parameter of the at least one first time interval and/or of the at least one second time interval dynamically.

4. The cooking appliance apparatus of claim 3, wherein the at least one parameter is defined by at least one interval length and/or at least one interval position.

5. The cooking appliance apparatus of claim 1, wherein the control unit is configured to adjust the at least one parameter in the incorrect operating state such that the at least one second time interval is arranged entirely within the at least one first time interval.

6. The cooking appliance apparatus of claim 1, wherein the at least one switching characteristic is a heating current characteristic.

7. The cooking appliance apparatus of claim 1, wherein the control unit is configured to determine a presence of at least one time point of the at least one second time interval, which lies outside the at least one first time interval.

8. The cooking appliance apparatus of claim 7, wherein the control unit is configured to determine the at least one time point from a comparison of at least one detected switching characteristic with a setpoint switching state.

9. The cooking appliance apparatus of claim 7, wherein the control unit is configured to determine at least one temporal position characteristic of the at least one time point.

10. The cooking appliance apparatus of claim 1, wherein the detection unit is configured to output a high level in the incorrect operating state.

11. A cooking appliance, comprising at least one cooking appliance apparatus comprising at least one inductor, at least one inverter configured to supply a high-frequency heating current for the at least one inductor, at least one switch configured to break and/or establish at least one conduction path between the at least one inverter and the at least one inductor, and a control unit configured to deactivate the at least one inverter during at least one first time interval and to initiate a switching of the at least one switch, with the switching starting and ending within at least one second time interval, which in a normal operating state is arranged within the at least one first time interval and which in an incorrect operating state has at least one time point, which lies outside the at least one first time interval, said control unit being configured to match the at least one first time interval and the at least one second time interval dynamically to one another, the control unit including:

at least one detection unit configured to detect at least one switching characteristic of the at least one switch;

at least one voltage detector for detecting a potential profile, and a logic unit for processing the detected potential profile.

12. The cooking appliance of claim 11, wherein the control unit is configured to change at least one parameter of the at least one first time interval and/or of the at least one second time interval dynamically.

13. The cooking appliance of claim 12, wherein the at least one parameter is defined by at least one interval length and/or at least one interval position.

14. The cooking appliance of claim 11, wherein the control unit is configured to adjust the at least one parameter in the incorrect operating state such that the at least one second time interval is arranged entirely within the at least one first time interval.

15. The cooking appliance of claim 11, wherein the at least one switching characteristic is a heating current characteristic.

16. The cooking appliance of claim 11, wherein the control unit is configured to determine a presence of at least one time point of the at least one second time interval, which lies outside the at least one first time interval.

17. The cooking appliance of claim 16, wherein the control unit is configured to determine the at least one time point from a comparison of at least one detected switching characteristic with a setpoint switching state.

18. The cooking appliance of claim 16, wherein the control unit is configured to determine at least one temporal position characteristic of the at least one time point.

19. The cooking appliance of claim 11, wherein the detection unit is configured to output a high level in the incorrect operating state.

20. A method for operating a cooking appliance apparatus, comprising:

deactivating an inverter, which supplies high-frequency heating current to an inductor, during a first time interval;

initiating switching of a switch, which breaks and/or establish at least one conduction path between the inverter and the inductor, within a second time interval, which in a normal operating state is arranged within the first time interval and which in an incorrect operating state has at least one time point, which lies outside the first time interval; and dynamically matching the first time interval and the second time interval to one another by using a control unit, the control unit including:

a detection unit configured to detect at least one switching characteristic of the switch;

a voltage detector for detecting a potential profile, and a logic unit for processing the detected potential profile.

* * * * *